US005489122A

United States Patent [19]

Pittner

[11] Patent Number: 5,489,122

[45] Date of Patent: Feb. 6, 1996

[54] PERSONAL TENNIS SCORE KEEPER

[76] Inventor: Dusan Pittner, P.O. Box 410, Mansfield, Mass. 02048

[21] Appl. No.: 345,596

[22] Filed: Nov. 28, 1994

[51] Int. Cl.[6] ..... A63B 49/02

[52] U.S. Cl. ..... 283/49; 116/225; 116/323; 273/DIG. 26

[58] Field of Search ..... 116/225, 323, 116/324; 273/DIG. 26; 283/49

[56] References Cited

U.S. PATENT DOCUMENTS

| | | | |
|---|---|---|---|
| 168,395 | 10/1875 | Harris | 116/323 |
| 3,936,963 | 2/1976 | Chan | 116/223 X |
| 4,132,187 | 1/1979 | Moebius | 116/225 |
| 4,158,342 | 6/1979 | Scruggs | 116/225 |
| 4,189,143 | 2/1980 | Van Auken et al. | 116/222 X |
| 4,202,544 | 5/1980 | Popma | 273/DIG. 26 |
| 4,331,098 | 5/1982 | Rubano | 116/225 |
| 4,498,668 | 2/1985 | Bowen | 116/225 |
| 4,712,504 | 12/1987 | Zarley et al. | 116/222 |
| 4,738,449 | 4/1988 | Droz | 116/222 X |
| 5,048,452 | 9/1991 | Haddock et al. | 116/225 |

FOREIGN PATENT DOCUMENTS

| | | | |
|---|---|---|---|
| 672986 | 1/1930 | France | 116/323 |
| 119504 | 8/1927 | Switzerland | 116/323 |

*Primary Examiner*—Frances Han

[57] ABSTRACT

A personal tennis score keeper comprising a strip of sheet material having an upper surface and a lower surface and with the upper surface thereof bearing squares arranged in a linear array and forming three columns, one of the columns bearing indicia indicating the number of games won by a player, another column bearing indicia indicating the number of games won by an opposing player, and the remaining column bearing indicia for indicating a score of each player during a game; and a plurality of scoring markers slidably secured to the strip in a juxtaposed slidable relation with respect to a column for marking a score.

1 Claim, 3 Drawing Sheets

PERSONAL TENNIS SCORE KEEPER

BACKGROUND OF THE INVENTION

1. Field of the Invention

The present invention relates to a personal tennis score keeper and more particularly pertains to allowing a player to maintain an accurate scoring during play of a tennis match with a personal tennis score keeper.

2. Description of the Prior Art

The use of scoring devices of a wide variety of designs and configurations is known in the prior art. More specifically, scoring devices of a wide variety of designs and configurations heretofore devised and utilized for the purpose of for assisting players of games in maintaining the score through a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 314,711 to Cox discloses a tennis score recorder. U.S. Pat. No. 3,730,131 to Izzo discloses a tennis score computer. U.S. Pat. No. 4,165,710 to Gaetano discloses a tennis score keeping device. U.S. Pat. No. 4,189,143 to Van Auken et al. discloses a tennis scorekeeper. U.S. Pat. No. 4,331,098 to Rubano discloses a tennis score keeper. U.S. Pat. No. 4,738,449 to Droz discloses a score marker for tennis.

While these devices fulfill their respective, particular objective and requirements, the aforementioned patents do not describe a personal tennis score keeper that allows a player to keep track of his score and his opponent's score during a game as well as the number of games won.

In this respect, the personal tennis score keeper according to the present invention substantially departs from the conventional concepts and designs of the prior art, and in doing so provides an apparatus primarily developed for the purpose of for allowing a player to maintain an accurate scoring during play of a tennis match.

Therefore, it can be appreciated that there exists a continuing need for new and improved personal tennis score keeper which can be used for allowing a player to maintain an accurate scoring during play of a tennis match. In this regard, the present invention substantially fulfills this need.

SUMMARY OF THE INVENTION

In the view of the foregoing disadvantages inherent in the known types of scoring devices of a wide variety of designs and configurations now present in the prior art, the present invention provides an improved personal tennis score keeper. As such, the general purpose of the present invention, which will be described subsequently in greater detail, is to provide a new and improved personal tennis score keeper and method which has all the advantages of the prior art and none of the disadvantages.

To attain this, the present invention essentially comprises, in combination, a rectangular strip of plastic sheet material having an upper surface, a lower surface, a periphery formed of two opposed long edges and two opposed short edges interconnecting the upper surface with the lower surface, and an elongated central rectangular portion with the upper surface thereof bearing squares arranged in a linear array and forming a first column, a third column, and a second column therebetween. The first and third columns each include a succession of seven equally sized squares with each square bearing a sequential number from "0" through "6" inclusive for indicating the number of games won by each player. The second column includes a succession of nine equally sized squares with the central square of the second column crosswise aligned with the central squares of the first and second columns and with the remaining squares of the second column each crosswise aligned with a corresponding square of both the first and third columns. The central square of the second column bears the symbol "AA" for indicating an advantage for a player during play. The squares of the second column on opposite sides of the central square each bear the number "40". The two outermost squares of the second column each bear the number "0". The squares of the second column adjacent to the outermost squares thereof each bear the number "15". Lastly, the remaining squares of the second column each bear the number "30". The numbers of the second column indicate a score for each player during a game. The central portion of the strip further includes a pair of opposed elongated undercut horizontal outer slots with each outer slot formed on a separate long edge and a pair of elongated undercut central slots formed thereon with each central slot positioned between adjacent columns and having a generally T-shaped cross section. The strip further includes an upper rectangular portion and a lower portion with the portions located at opposite ends of the central portion and terminating the central slots. The upper portion has a wide extent for allowing custom indicia to be disposed thereon.

Scoring markers are also provided. The scoring markers are formed of a first, a second, a third, and a fourth rigid tinted translucent plastic window. Each window has a square planar inner portion with an upper surface peripherally outlined with a black edge for highlighting a score, a lower surface, a top edge, a bottom edge, and opposed side edges interconnecting the top edge with the bottom edge. Each window also includes a pair of opposed interiorly facing fingers extended perpendicularly downwards from the lower surface and with each finger having a L-shaped cross section. The first widow has its inner portion positioned over the first column for marking a score and with one of its fingers slidably secured within the outer slot adjacent to the first column and its other finger slidably secured within the central slot between the first column and second column. The second widow and third window have their inner portions positioned over the second column on opposite sides of the central square thereof for marking a score. The second window and third window each have a finger slidably secured within the central slot between the first column and second column. The second window and third window each also have another finger slidably secured within the central slot between the second column and third column. The fourth widow has its inner portion positioned over the third column for marking a score and with one of its fingers slidably secured within the central slot between the second column and the third column and its other finger slidably secured in the outer slot adjacent to the third column. A layer of adhesive is included and secured to the lower surface of the strip. Also included is a strip of peel-off backing removably secured over the layer of adhesive. The backing is removable for allowing the strip to be secured to a neck of a tennis racquet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S.Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved personal tennis score keeper which has all the advantages of the prior art scoring devices of a wide variety of designs and configurations and none of the disadvantages.

It is another object of the present invention to provide a new and improved personal tennis score keeper which may be easily and efficiently manufactured and marketed.

It is a further object of the present invention to provide a new and improved personal tennis score keeper which is of durable and reliable construction.

An even further object of the present invention is to provide a new and improved personal tennis score keeper which is susceptible of a low cost of manufacture with regard to both materials and labor, and which accordingly is then susceptible of low prices of sale to the consuming public, thereby making such a personal tennis score keeper economically available to the buying public.

Still yet another object of the present invention is to provide a new and improved personal tennis score keeper which provides in the apparatuses and methods of the prior art some of the advantages thereof, while simultaneously overcoming some of the disadvantages normally associated therewith.

Even still another object of the present invention is to provide a new and improved personal tennis score keeper for allowing a player to maintain an accurate scoring during play of a tennis match.

Lastly, it is an object of the present invention to provide a new and improved personal tennis score keeper comprising a strip of sheet material having an upper surface and a lower surface and with the upper surface thereof bearing squares arranged in a linear array and forming three columns, one of the columns bearing indicia indicating the number of games won by a player, another column bearing indicia indicating the number of games won by an opposing player, and the remaining column bearing indicia for indicating a score of each player during a game; and a plurality of scoring markers slidably secured to the strip in a juxtaposed slidable relation with respect to a column for marking a score.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
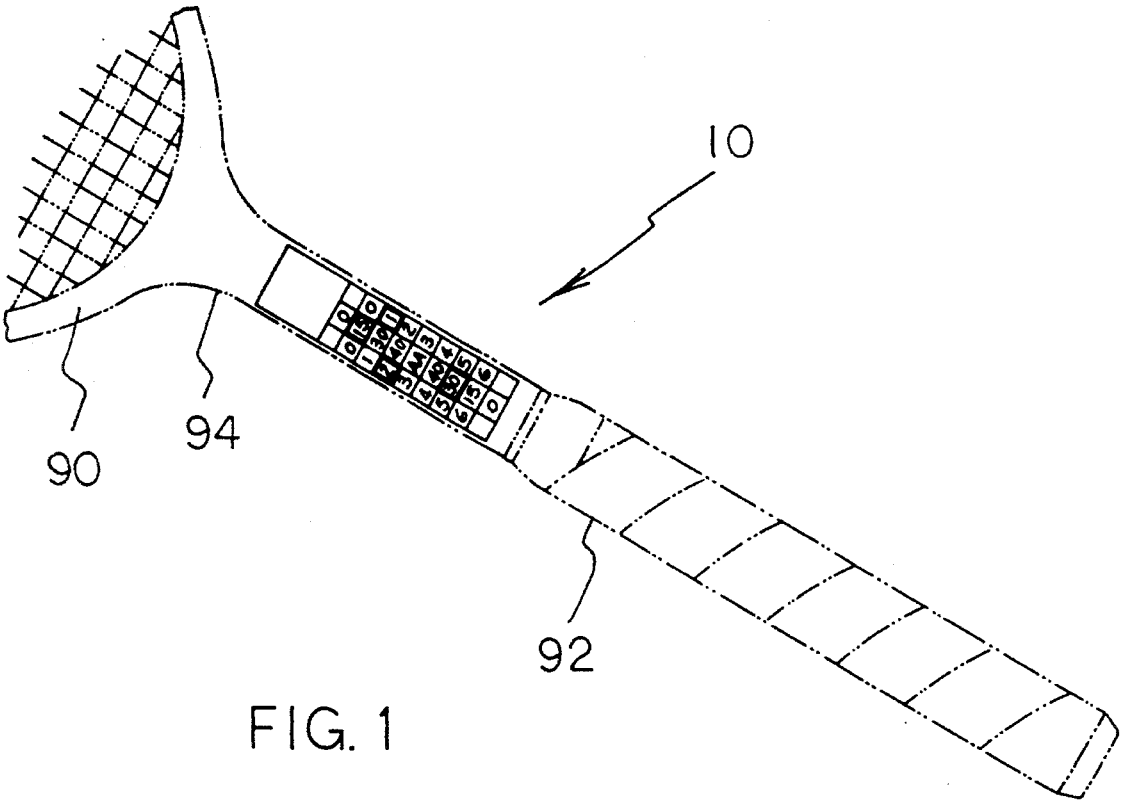
FIG. 1 is a view of the preferred embodiment constructed in accordance with the principles of the present invention secured to a tennis racket. The present invention can also be formed as an integral part of the tennis racket.
Figure 2:
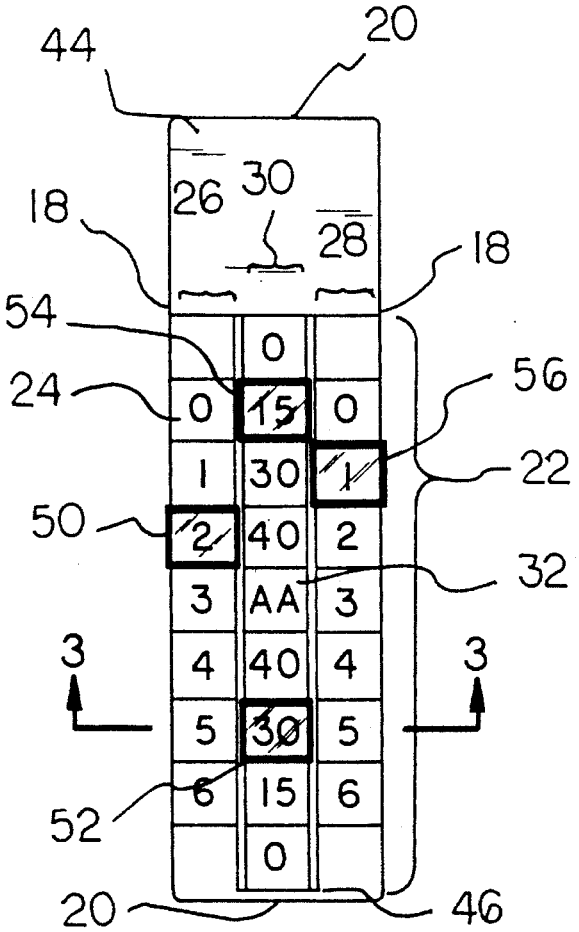
FIG. 2 is an enlarged view of the preferred embodiment in operation during a game of tennis.
Figure 3:
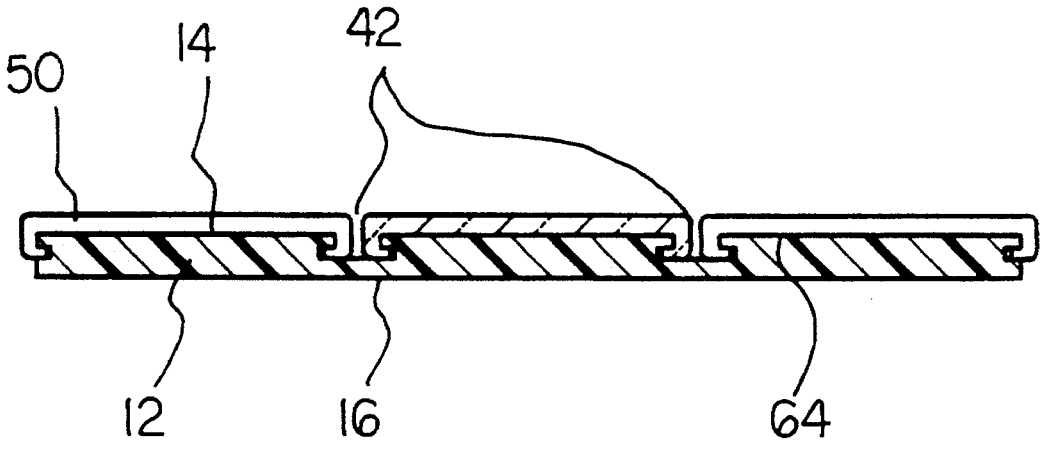
FIG. 3 is a cross-section view of the present invention taken along the line 3—3 of FIG. 2.
Figure 4:
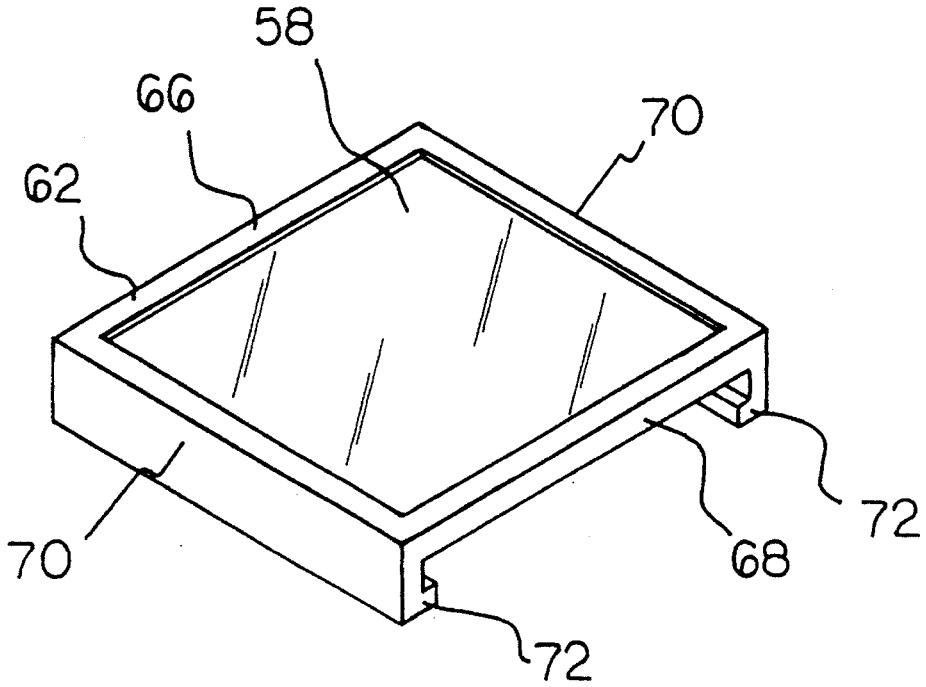
FIG. 4 is an enlarged perspective view of a window of the present invention.
Figure 5:
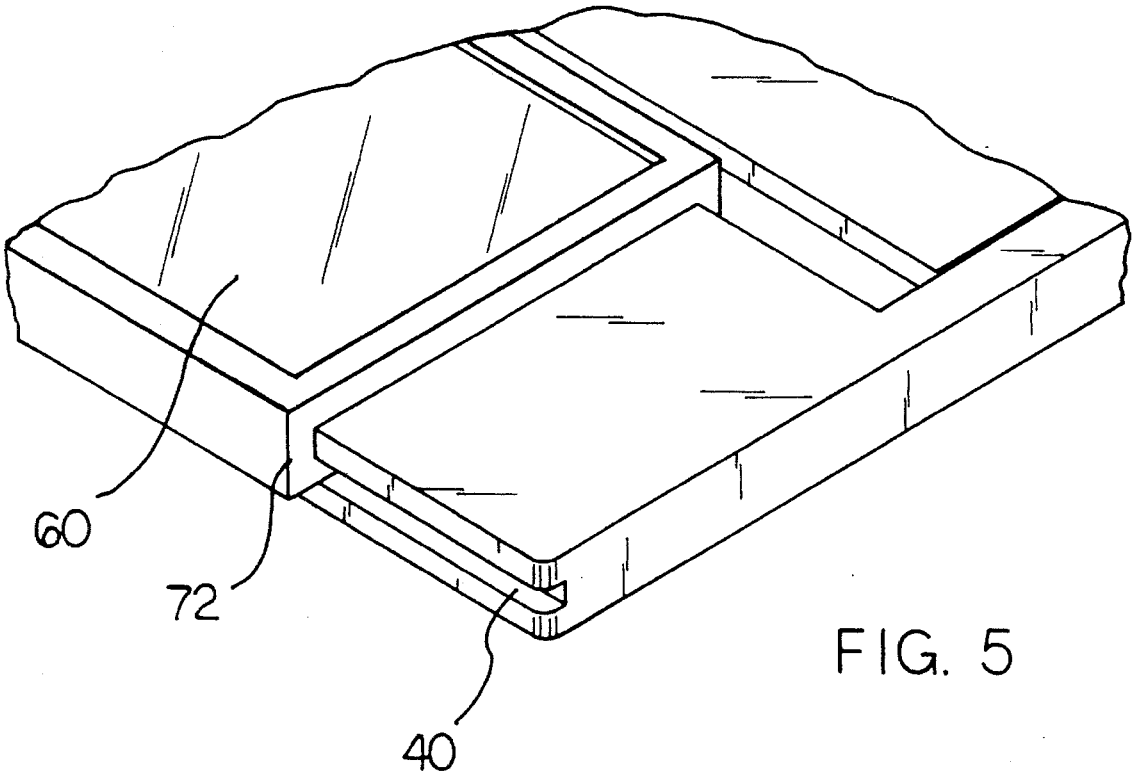
FIG. 5 is an enlarged perspective view of a portion of the present invention.
Figure 6:
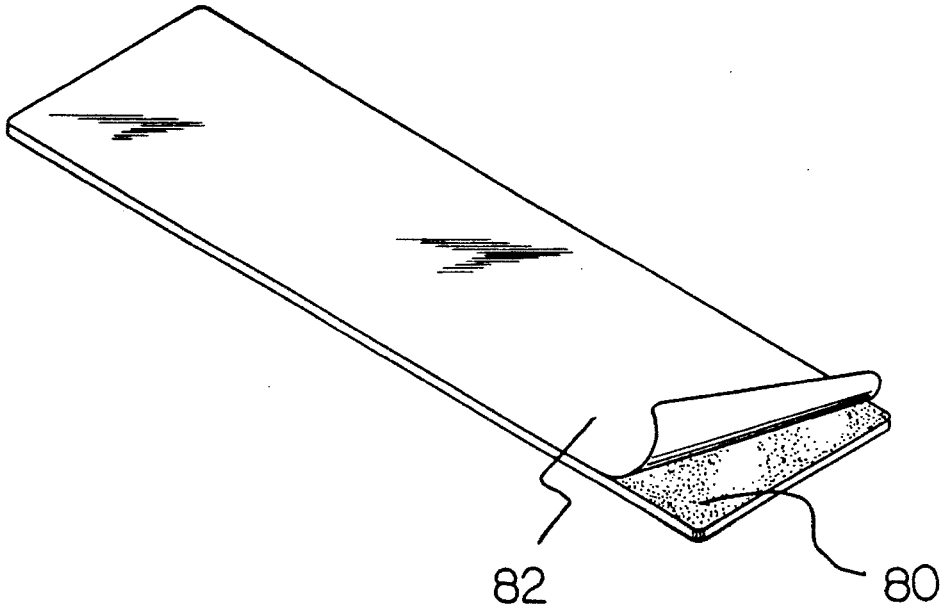
FIG. 6 is a view of the back of the present invention depicting the means used for coupling it to a recipient surface such as that on a tennis racket.

With reference now to the drawings, and in particular, to FIG. 1 thereof, the preferred embodiment of the new and improved personal tennis score keeper embodying the principles and concepts of the present invention and generally designated by the reference number 10 will be described.

The present invention is comprised of a plurality of components. In their broadest context, such components include a strip and scoring markers. Such components are individually configured and correlated with respect to each other to provide the intended function of allowing a player to maintain an accurate scoring during play of a tennis match.

Specifically, the present invention includes a rectangular strip 12. The rectangular strip is formed of a plastic sheet material. The sheet material can be rigid or flexible in structure. Other similar materials such as wood or metal may also be utilized. The strip includes an upper surface 14, a lower surface 16, and a periphery formed of two opposed long edges 18 and two opposed short edges 20 interconnecting the upper surface with the lower surface. The strip includes an elongated rectangular central portion 22. The upper surface of the central portion bears squares 24 arranged in a linear array and forming a first column 26, a third column 28, and a second column 30 therebetween. The first and third columns each include a succession of seven equally sized squares with each square bearing a sequential number from "0" to "6" inclusive. The numbers on the first and third columns indicate the number of games won by each player. The second column includes a succession of nine equally sized squares with the central square 32 of the second column crosswise aligned with the central squares of the first and second columns. The remaining squares of the second column are each crosswise aligned with the corresponding squares of both the first and third columns. The central square of the second column bears the symbol "AA" for indicating an advantage for a player during play. Other indicative symbols for indicating an advantage by a particular player may also be utilized. The squares of the second column on opposite sides of the central square 32 each bear the number "40". The two outermost squares of the second column each bear the number "0". The squares of the second column adjacent to the outermost squares each bear the number "15". The remaining squares of the second column each bear the number "30". The numbers of the second column indicate a score for each player during a game. The numbers represent the standard scoring increments of a typical game of tennis. The numbers located below the central square of the second column are be used by a player for keeping track of his score and the numbers positioned above the central square of the second column are used by a player for keeping track of his opponent's score. The central portion of the strip also includes a pair of opposed elongated undercut and horizontal outer slots 40. Each outer slot is formed on a separate long edge 18. Also included is a pair of elongated undercut central slots 42. The central slots are formed on the central portion with each central slot positioned between adjacent columns. Each central slot also has a generally T-shaped cross-section. The strip further includes an upper rectangular portion 44 and a lower portion 46. The upper and lower portions are located at opposite ends of the central portion and are used for terminating the central slots thereon. The upper portion has a wide extent for allowing custom indicia such as logos, trademarks, or other distinctive symbology to be disposed thereon. Furthermore, the upper portion may also be utilized for jotting notes for use during or after play.

Also included with the present invention is a plurality of scoring markers. The scoring markers are formed of a first window 50, a second window 52, a third window 54, and a fourth window 56. Each of the windows is formed of a tinted translucent plastic. The windows can be also formed of a transparent material. Each window has a square planar inner portion 58. The inner portion has an upper surface 60 peripherally outlined with a black edge 62 for highlighting a score. Other colors can also be utilized for the edge. The inner surface also has a lower surface 64. A periphery formed of a top edge 66, a bottom edge 68, and opposed side edges 70 interconnect the top edge with the bottom edge. Each window also includes a pair of opposed and interiorly facing fingers 72. The fingers are extended perpendicularly downwards from the lower surface. Each finger has an L-shaped cross-section formed of a long leg and a short leg. The short legs are positioned such that they are projected towards each other. The first window 50 has its inner portion positioned over the first column 26 for indicating and marking a score. One of the fingers of the first window is slidably secured within the outer slot 40 that is located adjacent to the first column. The other finger of the first window is slidably secured within the central slot 42 that is located between the first column and second column. The second window 52 and third window 54 each have their inner portions positioned over the second column on opposite sides of the central square 32 for indicating and marking a score of a player and his opponent. The second window has one of its fingers slidably secured within the central slot 42 at a location between the first column and the second column. The other finger of the second window is slidably secured within the central slot 42 located between the second column and third column. The third window has one of its fingers slidably secured within the central slot 42 between the first column and second column. The other finger of the third window is slidably secured within the central slot 42 between the second column and third column. The fourth window 56 has its inner portion positioned over the third column for indicating and marking a score. One of the fingers of the fourth window is slidably secured within the central slot that is located between the second column and the third column. The other finger of the fourth window is slidably secured in the outer slot that is located adjacent to the third column. Through the use of this type of coupling, the windows are slidably positionable along the extent of a column for marking and indicating scoring of a match of tennis to a player.

To secure the strip to a recipient surface such as a tennis racquet, a layer of adhesive 80 is included. The layer of adhesive is secured to the lower surface 16 of the strip. The layer of adhesive includes a strip of peel-off backing 82 removably secured thereover. The backing is removed for allowing the strip to be secured to a neck of a tennis racquet.

A second embodiment of the present invention includes substantially all of the components of the present invention except that it is formed as an integral part of a tennis racquet. The tennis racquet used has a head 90, a handle 92, and a neck 94 therebetween. The neck itself bears the plurality of squares arranged in three columns as previously described instead of the strip of sheet material. Thus, the column structure and symbology previously described as part of the strip are now inherently part of the neck of the tennis racquet itself. As with the preferred embodiment, the second embodiment includes scoring markers that are slidably secured to the neck in a juxtaposed slidable relation with respect to the columns for indicating a score.

The present invention is designed to help tennis players keep an accurate score keeping during a tennis match. It shall eliminate confusion and arguments caused by player's frequent memory lapses. Additional benefit will be realized for young players (age 9–13) who are in the process of learning the rules of the tennis game.

After every point played, the player(s) will simply mark the game score by shifting his or the opponent's button (depending on who won the point) to the next available place on the middle scale. Points and advantages will be marked by advancing the button back and forth. The side scales are reserved for keeping the game score in the set currently played. Tennis players of all ages and playing levels would find the present invention beneficial. The design and color of the present invention may vary depending upon the equipment to which it is affixed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A personal tennis score keeper for allowing a player to maintain an accurate scoring during play of a tennis match comprising, in combination:

a rectangular strip of plastic sheet material having an upper surface, a lower surface, a periphery formed of two opposed long edges and two opposed short edges interconnecting the upper surface with the lower surface, and an elongated central rectangular portion with the upper surface thereof bearing squares arranged in a linear array and forming a first column, a third column, and a second column therebetween, the first and third columns each including a succession of seven equally sized squares with each square bearing a sequential number for indicating the number of games won by each player, the second column including a succession of nine equally sized squares with a central square of second column crosswise aligned with the central squares of the first and second columns and with the remaining squares of the second column each crosswise aligned with a corresponding square of both the first and third columns, the central square of the second column bearing a symbol for indicating an advantage for a player during play, the squares of the second column on opposite sides of the central square each bearing a first number, the two outermost squares of the second column each bearing a second number the squares of the second column adjacent to the outermost squares each bearing a third number, and the remaining squares of the second column each bearing a fourth number and with the numbers of the second column indicating a score for each player during a game, the central portion of the strip further having a pair of opposed elongated undercut horizontal outer slots with each outer slot formed on a separate long edge and a pair of elongated undercut central slots formed thereon with each central slot positioned between adjacent columns and having a generally T-shaped cross section, the strip further including an upper rectangular portion and a lower portion with the portions located at opposite ends of the central portion;

scoring markers including first, second, third, and fourth rigid tinted translucent plastic windows, each window having a square planar inner portion with an upper surface peripherally outlined with a black edge for highlighting a score, a lower surface, a top edge, a bottom edge, opposed side edges interconnecting the top edge with the bottom edge, and a pair of opposed interiorly facing fingers extended perpendicularly downwards from the lower surface and with each finger having a L-shaped cross section, the first window having its inner portion positioned over the first column for marking a score and with one of the fingers of the first window slidably secured within an outer slot adjacent to the first column and another of the fingers of the first window slidably secured within the central slot between the first column and second column, the second window and third window having their inner portions positioned over the second column on opposite sides of the central square thereof for marking a score, the second window and third window each having one finger slidably secured within the central slot between the first column and second column, the second window and third window each also having another finger slidably secured within the central slot between the second column and third column, the fourth widow having its inner portion positioned over the third column for marking a score and with one of the fingers of the fourth window slidably secured within the central slot between the second column and the third column and another of the fingers of the fourth window slidably secured in the outer slot adjacent to the third column; and a layer of adhesive secured to the lower surface of the strip and further including a strip of peel-off backing removably secured thereoVer and with the backing removed for allowing the strip to be secured to a neck of a tennis racquet.

* * * * *